United States Patent [19]

Wiech, Jr.

[11] Patent Number: 4,722,824

[45] Date of Patent: Feb. 2, 1988

[54] METHOD OF JOINING GREEN BODIES PRIOR TO SINTERING

[75] Inventor: Raymond E. Wiech, Jr., San Diego, Calif.

[73] Assignee: Fine Particle Technology Corp., Camarillo, Calif.

[21] Appl. No.: 870,416

[22] Filed: Jun. 4, 1986

[51] Int. Cl.[4] ..... B22F 7/02; B23K 9/23

[52] U.S. Cl. ..... 419/6; 419/30; 419/38; 419/44; 29/DIG. 13; 29/DIG. 46; 219/93; 219/118; 428/548; 228/110

[58] Field of Search ..... 419/6, 30, 38, 44; 428/548; 219/93, 118; 228/110, 231, 1.1; 29/DIG. 13, DIG. 46

[56] References Cited

U.S. PATENT DOCUMENTS

| | | | |
|---|---|---|---|
| 2,939,199 | 6/1960 | Strivens | 264/101 |
| 2,985,954 | 5/1961 | Jones et al. | 310/26 |
| 4,019,876 | 4/1977 | Stockel et al. | 228/110 |
| 4,047,657 | 9/1977 | Mins | 228/110 |
| 4,119,260 | 10/1978 | Stoeckel | 228/111 |
| 4,139,140 | 2/1979 | Stockel | 228/110 |
| 4,247,036 | 1/1981 | Salesse et al. | 228/195 |
| 4,294,392 | 10/1981 | Colloff | 228/111 |
| 4,305,756 | 12/1981 | Wiech, Jr. | 419/36 |
| 4,404,166 | 9/1983 | Wiech, Jr. | 419/44 |
| 4,486,385 | 12/1984 | Aslund | 419/6 |
| 4,536,637 | 8/1985 | Horivchi et al. | 219/118 |
| 4,539,197 | 9/1985 | Asaka et al. | 419/6 |
| 4,545,519 | 10/1985 | Renshaw et al. | 228/1.1 |
| 4,628,178 | 12/1986 | Miyake et al. | 219/118 |

FOREIGN PATENT DOCUMENTS

| | | | |
|---|---|---|---|
| 2139131 | 11/1984 | United Kingdom | 219/118 |
| 1201090 | 12/1985 | U.S.S.R. | 219/118 |

*Primary Examiner*—Stephen J. Lechert, Jr.
*Assistant Examiner*—Eric Jorgensen
*Attorney, Agent, or Firm*—Jay M. Cantor

[57] ABSTRACT

The disclosure relates to a method whereby complex shapes, not moldable in a single molding operation, are molded in plural parts, each part being of the same or different powdered metal composition or prealloy of the type disclosed. One or more of the parts preferably has bumps or dimples thereon for joining to another of the parts in the manner to be described. The other part can also have depressions for receiving the bumps to aid in alignment of the parts prior to processing.

18 Claims, 1 Drawing Figure

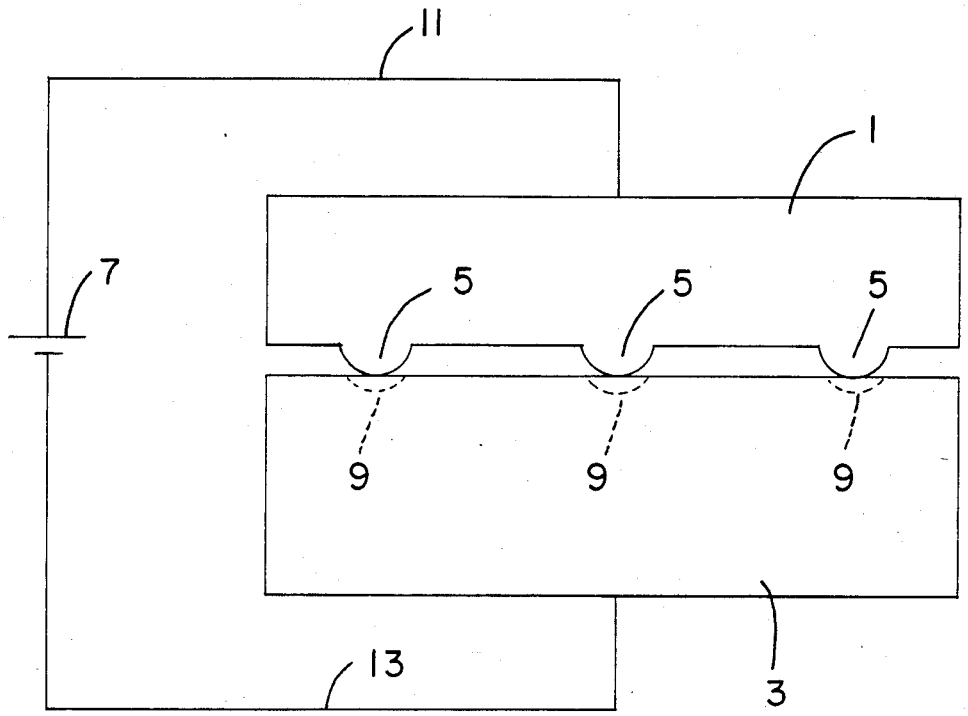
11
1
7
5
5
5
9
9
9
13
3

METHOD OF JOINING GREEN BODIES PRIOR TO SINTERING

BACKGROUND OF THE INVENTION

1. Field of the Invention

This invention relates to a method of joining together "green" bodies of shaped powdered metal forms and, more specifically, to a method of connecting together binder containing powdered metal shaped forms prior to sintering to form a compound form composed of the plural bodies connected together to form a single body.

2. Brief Description of the Prior Art

It is often desirable or even necessary to provide parts which can be economically formed using powdered metal and binder in accordance with the techniques disclosed in the patents of Wiech U.S. Pat. Nos. 4,305,756, 4,404,166 or 4,197,291 as well as the patents of Strivens U.S. Pat. No. 2,939,199, U.K. No. 779,242 and U.K. No. 808,583 and others but for the inability to provide a single mold wherein the part can be formed due to the shape of the form to be produced. This problem is well known in the molding art. A further problem encountered is when it is necessary or desirable to provide a form using different materials at different portions of the form. This problem has also not been solved using a single mold although the patent to Wiech U.S. Pat. No. 4,562,092 does disclose a solution to the problem using plural molding steps and plural molds.

It is therefore readily apparent that a technique whereby complex shapes which are not moldable in a single mold can be formed in accordance with the techniques of the above noted Wiech and Strivens patents would be highly useful and lead to the ability to provide forms in shapes heretofore unobtainable or only obtainable at great economic expense. In accordance with the present invention, the above problem is overcome and there is provided a method whereby complex shapes, not readily moldable in a single mold, of either one or plural compositions, can be economically formed, using the techniques described in the above noted Wiech and Strivens patents.

SUMMARY OF THE INVENTION

Briefly, in accordance with the present invention, there is provided a method whereby complex shapes, not moldable in a single molding operation, are molded in plural parts, each part being of the same or different powdered metal composition or prealloy of the type disclosed in the above noted Wiech and Strivens patents. One or more of the parts preferably has bumps or dimples thereon for joining to another of the parts in the manner to be described. The other part can also have depressions for receiving the bumps to aid in alinement of the parts prior to processing.

In accordance with the method, parts or forms of electrically conductive powdered metal and binder are molded in accordance with the above noted techniques to the desired shape, with appropriate bumps and/or depressions therein, the molded shape also being electrically conducting. At this stage, the part contains powdered metal and binder and is termed a "green" body. Plural parts are then placed in intimate contact with each other with bumps (the preferred embodiment) and/or depressions, if present, being used as discussed above for alinement. An electric current is then passed through the green bodies in accordance with standard spot welding techniques, the exact nature of which is dependent upon the specific parts being joined. The passage of the electric current through the "green" body heats the body sufficiently to cause intermingling of the particles of the metal across the green body boundaries due to localized melting of the binder and thereby causes the green bodies to adhere to each other. Vibration techniques, such as ultrasonic welding, can be used, in addition, to enhance particle intermingling. In the case where the bumps are utilized, the current density through the bumps will be greater than in the remainder of the body and thereby cause a greater amount of heat to be generated at the bumps that in the remainder of the green body. This will cause a greater amount of particle intermingling to take place at the bumps as compared with a bump-free embodiment. The multiple connected "green" bodies are than placed in a debinderizer for removal of all or part of the binder and then sintered in accordance with the procedures set forth in the above noted Wiech or Strivens patents. It can be seen that, in accordance with the present invention, multiple shapes can be individually molded, using the same or different powdered metals, and sintered together to form a shape which would otherwise not be attainable using known injection molding techniques. It is also readily apparent that, though the preferred embodiment is described using two parts connected together, any number of such parts can be connected together to form complex shapes or tiered structures of the same or different shapes.

BRIEF DESCRIPTION OF THE DRAWING

The drawing is a schematic diagram of a circuit and set up in accordance with the present invention.

DESCRIPTION OF THE PREFERRED EMBODIMENT

Referring now to the FIGURE, there is shown a schematic diagram of an arrangement for connecting a pair of 92% by weight iron, 8% by wieght nickel "green" bodies in accordance with the present invention. The "green" bodies are labelled 1 and 3 and are depicted at the stage in the operation set forth in the above noted Wiech and Strivens patents wherein the feed stock composed of electrically conductive powdered metal and binder has been mixed to provide the homogeneous feed stock and the feed stock has then been injection molded to the shape of the mold to provide the electrically conductive "green" part. Though the electrically conductive shapes shown are substantially rectangular, it should be understood that the shapes would normally be of complex geometry in actual practice. The "green" body 1 is shown to have dimples or bumps 5 along one surface in the preferred embodiment though it should be understood that such dimples or bumps could be located on plural surfaces of the body 1. The dimples 5 are in contact with the "green" body 3 which is normally a complex shape, the same or different from the "green" body 1 and of the same or different powdered metal. As an alternate embodiment, the "green" body 3 can have depressions therein, shown by dotted lines 9, to receive the dimples 5 and aid in alignment of the parts 1 and 3 with each other. An electric current sufficient in magnitude and duration to melt the binder at the contact points, typical of spot welding technology, is applied across the bodies 1 and 3 from a voltage source 7 via conductors 11 and 13 to cause current to pass through the green body 1 to the green body 3 via the dimples 5. Due to the concentration of current at the dimples 5, some intermingling of the particles of metal takes place across the boundary of bodies 1 and 3 at the dimples to provide a physical attachment of the bodies to each other. The combined body formed from bodies 1 and 3 is then debinderized in accordance with the prior art procedures set forth in the above noted Wiech and Strivens patents and the complex body is then sintered in accordance with the procedures set forth in said Wiech and Strivens patents to provide the final metal shape. The complex shapes formed by the above noted procedure retain their shape after sintering and shrinkage and sinter to eachh other in such a manner that no line of demarcation between the original bodies 1 and 3 is observable other than for differences in material composition.

It can be seen that there has been provided a method for forming complex metal shapes of one or more segregated materials which is relatively simple and inexpensive and wherein the end products were substantially unobtainable in prior art powdered metal technology.

Though the invention has been described with respect to a specific preferred embodiments thereof, many variations and modifications will immediately become apparent to those skilled in the art. It is therefore the intention that the appended claims be interpreted as broadly as possible in view of the prior art to include all such variations and modifications.

I claim:

1. A method of forming complex geometric shapes comprising the steps of:

(a) providing a first geometrical shape of green compact composed of homogeneously dispersed electrically conductive sinterable powdered metal and binder, (b) providing a second geometrical shape of green compact composed of homogeneously dispersed electrically conductive sinterable powdered metal and binder, (c) placing regions of said first and second shapes in intimate contact with each other, (d) passing an electrical current across regions of said intimate contact between said shapes to cause intermingling of the powdered metal of each of said shapes across the boundaries of said shapes to form a composite of said first and second shapes, (e) removing binder from said composite shape of (d), and (f) sintering said shape of (e).

2. The method as set forth in claim 1 further including the step of providing said first shape with at least one dimple contacting said second shape.

3. The method as set forth in claim 2 further including the step of providing said second shape with at least one depression receiving said dimple therein.

4. The method as set forth in claim 1 wherein the metal in step (a) is different from the metal in step (b).

5. The method as set forth in claim 2 wherein the metal in step (a) is different from the metal in step (b).

6. The method as set forth in claim 3 wherein the metal in step (a) is different from the metal in step (b).

7. A method of forming complex geometric shapes comprising the steps of:

(a) providing a first geometrical shape of green compact composed of homogeneously dispersed electrically conductive sinterable powdered metal and a binder, (b) providing a second geometrical shape of green compact composed of homogeneously dispersed electrically conductive sinterable powdered metal and a binder;

(c) placing regions of said first and second shapes in intimate contact with each other, (d) vibrating said shapes to cause intermingling of the powdered metal of each of said shapes across the boundaries of said shapes, (e) removing binder from said shape of (d), and (f) sintering said shape of (e).

8. The method as set forth in claim 7 further including the step of providing said first shape with at least one dimple contacting said second shape.

9. The method as set forth in claim 8 further including the step of providing said second shape with at least one depression receiving said dimple therein.

10. The method as set forth in claim 9 wherein the metal in step (a) is different from the metal in step (b).

11. The method as set forth in claim 10 further including the step of passing an electrical current across regions of intimate contact between said shapes to cause intermingling of the powdered metal of each of said shapes across the boundaries of said shapes after step (d) to form a composite of said first and second shapes.

12. The method as set forth in claim 9 further including the step of passing an electrical current across regions of intimate contact between said shapes to cause intermingling of the powdered metal of each of said shapes across the boundaries of said shapes after step (d) to form a composite of said first and second shapes.

13. The method as set forth in claim 8 wherein the metal in step (a) is different from the metal in step (b).

14. The method as set forth in claim 11 further including the step of passing an electrical current across regions of intimate contact between said shapes to cause intermingling of the powdered metal of each of said shapes across the boundaries of said shapes after step (d) to form a composite of said first and second shapes.

15. The method as set forth in claim 8 further including the step of passing an electrical current across regions of intimate contact between said shapes to cause intermingling of the powdered metal of each of said shapes across the boundaries of said shapes after step (d) to form a composite of said first and second shapes.

16. The method as set forth in claim 7 wherein the metal in step (a) is different from the metal in step (b).

17. The method as set forth in claim 16 further including the step of passing an electrical current across regions of intimate contact between said shapes to cause intermingling of the powdered metal of each of said shapes across the boundaries of said shapes after step (d) to form a composite of said first and second shapes.

18. The method as set forth in claim 7 further including the step of passing an electrical current across regions of intimate contact between said shapes to cause intermingling of the powdered metal of each of said shapes across the boundaries of said shapes after step (d) to form a composite of said first and second shapes.

* * * * *